US009163390B2

(12) United States Patent
Pacaci

(10) Patent No.: US 9,163,390 B2
(45) Date of Patent: Oct. 20, 2015

(54) SUPPORTING FRAMEWORK HAVING CONNECTION NODES

(71) Applicant: Devrim Pacaci, Istanbul (TR)

(72) Inventor: Devrim Pacaci, Istanbul (TR)

( * ) Notice: Subject to any disclaimer, the term of this patent is extended or adjusted under 35 U.S.C. 154(b) by 0 days.

(21) Appl. No.: 14/383,108

(22) PCT Filed: Feb. 27, 2013

(86) PCT No.: PCT/IB2013/051569

§ 371 (c)(1),
(2) Date: Sep. 5, 2014

(87) PCT Pub. No.: WO2013/132391

PCT Pub. Date: Sep. 12, 2013

(65) Prior Publication Data

US 2015/0059263 A1 Mar. 5, 2015

(30) Foreign Application Priority Data

Mar. 6, 2012 (TR) ..... u 2012 02526

(51) Int. Cl.

| | |
|---|---|
| ***E04B 1/34*** | (2006.01) |
| ***E04H 1/12*** | (2006.01) |
| ***E04B 1/19*** | (2006.01) |
| ***E04B 1/24*** | (2006.01) |
| ***E04B 1/343*** | (2006.01) |

(52) U.S. Cl.

CPC ..... *E04B 1/1903* (2013.01); *E04B 1/1906* (2013.01); *E04B 1/24* (2013.01); *E04B 1/2403* (2013.01); *E04B 1/343* (2013.01); *E04B 1/34326* (2013.01); *E04B 1/34331* (2013.01); *E04B 1/1912* (2013.01); *E04B 2001/1927* (2013.01); *E04B 2001/1957* (2013.01); *E04B 2001/2406* (2013.01); *E04B 2001/2481* (2013.01); *E04B 2001/2496* (2013.01)

(58) Field of Classification Search

CPC ... E04B 1/1903; E04B 1/2403; E04B 1/1906; E04B 1/34326; E04B 1/34331; E04B 1/343; E04B 2001/2406; E04B 2001/1957; E04B 2001/1927; E04B 1/24; E04B 2001/2481; E04B 2001/2496; E04B 1/585; A47B 47/0008; A47B 47/0016; Y10T 403/342; Y10T 403/343; Y10T 403/347

See application file for complete search history.

(56) References Cited

U.S. PATENT DOCUMENTS

| | | | | |
|---|---|---|---|---|
| 4,480,418 | A * | 11/1984 | Ventrella | 52/655.2 |
| 4,922,669 | A * | 5/1990 | De Pas et al. | 52/646 |
| 8,820,025 | B1 * | 9/2014 | Rochas | 52/653.2 |

(Continued)

FOREIGN PATENT DOCUMENTS

| | | | |
|---|---|---|---|
| WO | WO0149950 | A1 | 7/2001 |
| WO | WO02081837 | A1 | 10/2002 |
| WO | WO2008027021 | A1 | 3/2008 |

*Primary Examiner* — Brian D Mattei
(74) *Attorney, Agent, or Firm* — Gokalp Bayramoglu

(57) ABSTRACT

The invention is about a supporting framework, having nodes and at least one framework component. The framework components are either panels or diagonal braces or a combination of them. At least one node has a connector and at least two bars. At least one connector has a plurality of bar receiving members that are located in a corresponding plurality of faces of an imaginary polyhedron and at least one bar has a first end, fixed to the one of the bar receiving members of the connector of a first node and a second end, fixed to the corresponding bar receiving member of the connector of another node. The node further comprise a holder for the diagonal braces or panels.

11 Claims, 10 Drawing Sheets

(56) References Cited

U.S. PATENT DOCUMENTS

Figure 1:
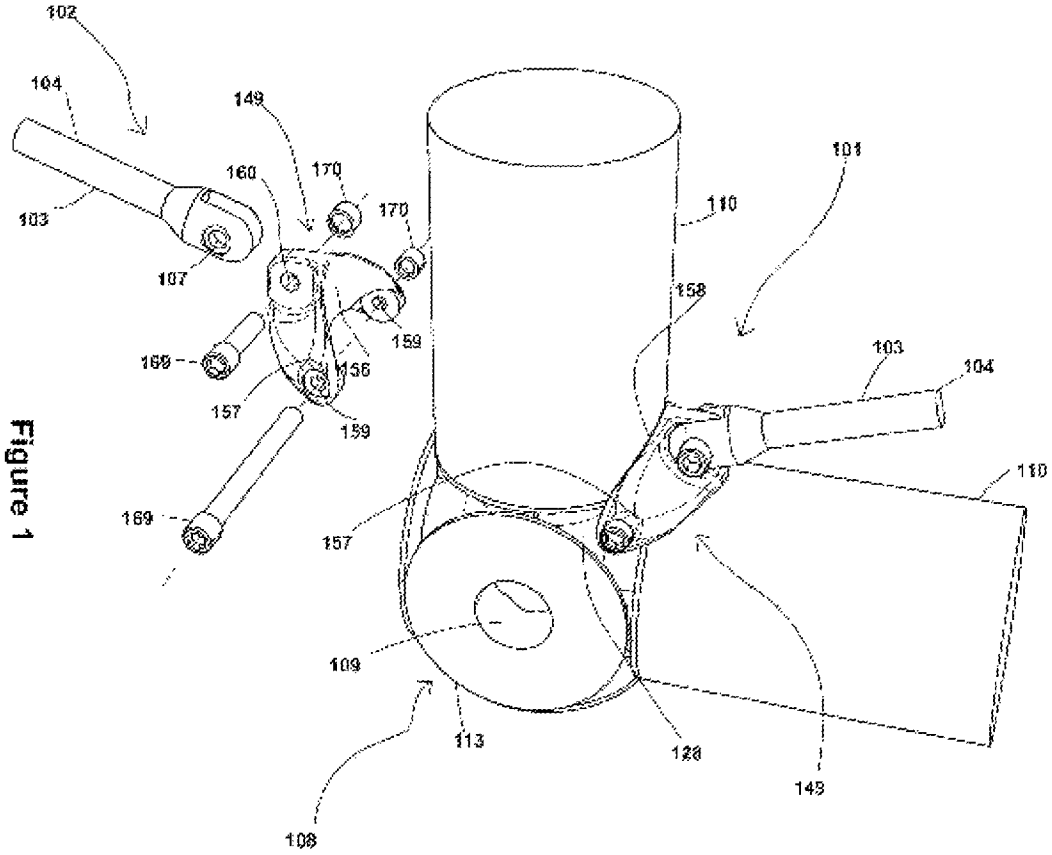

2005/0040312 A1* 2/2005 Tsai ..... 248/618
2008/0175655 A1 7/2008 Daubner
2014/0331591 A1* 11/2014 Ohlson ..... 52/653.2
2015/0021285 A1* 1/2015 Pacaci ..... 211/182

* cited by examiner

SUPPORTING FRAMEWORK HAVING CONNECTION NODES

1. TECHNICAL FIELD

This invention relates to a supporting framework, having connection nodes, the connection nodes having connectors, bars, and framework components, including panels and diagonal braces.

2. BACKGROUND ART

That type of framework systems have been known for a long time, and used both in temporary and contemporary structures. The connectors connect bars to each other, producing connection nodes. In those framework systems, especially in temporary structures, like fair stands or booths, the connectors are preferably manufactured from a durable material, like stainless steel, that can withstand the load and weariness due to the numerous connection/disconnection routines, while the bars are preferred to be manufactured from lightweight and preferably extrudable materials, like aluminum, to benefit from customizable cross sections. Therefore, in most cases, the connectors are the preferred elements in the framework system that the framework components, including panels and especially diagonal braces, are connected to. The panels are flat elements, used mainly for separation purposes and diagonal braces comprise elongated elements in the form of a rod, wire or a profile element, used for improving the load bearing capacity of the framework system and bear compression or tension forces or both.

Because the connectors are used numerously in those framework systems, the excess weight of an oversized connector has a limiting effect on the load bearing capacity of the overall system. The oversized connectors have negative effects, also on manufacturing costs and on labor costs due to the increased time for setting the system numerously up and down especially in temporary structures, like fair stands or booths.

Connectors are generally polyhedron shaped elements with faces that receive bars. For reasons of not getting oversized and stabilization of the bars, the faces are shaped in relation with the cross section of the bar that is received, in such a way that, is covered by the bar substantially, if possible. The peripheral surface of the connector get covered substantially, when each of the faces receive at least one bar and especially in the cases of the bars with cross sections, shaped as a convex polygon, especially a regular convex polygon or a circle. That type of bars is among the most widely used types of bars in the framework systems, due to their high torsional resistance. The problem arises when to add framework components to their connectors. In known framework systems, the connectors fail to receive the framework components without being considered as oversized, especially for the cases in those systems, when those connectors are also used without the framework components, regarding that the components are used in the system only where needed. The additional faces, physical elements or surface area, dedicated for attaching the components, increase the overall size of those connectors and make them considered as over-sized. Furthermore, the over-sized connectors and their additional features dedicated for attaching components which usually remain useless for the cases without them, usually have negative effects on the ability of the framework's capability of attaching panels, by interfering with them and bringing out a problem of making undesirable arrangements especially at the corners of that panels.

Among those polyhedron shaped connectors of known systems, there are lightweight connectors with hollow forms that have advantageous shape on attaching framework components, as in the prior art document; WO 02/081837 A. With certain modifications, aiming to make use of the cavity inside the connector and to attach the framework components, that type of connectors can come out to be able to receive framework components without a disadvantage of over-sizing. Because of being composed of flat elements, they are relatively lighter than the connectors other than hollow formed ones, but most of them have significantly poor load bearing capacity, because of the relatively small contact surfaces between the flat elements. Another document; WO 0149950 A discloses another hollow formed connector, with relatively higher stability. But, however, that connector, together with the former one, has a limited capacity, when it comes to adding diagonal braces. Because, in the case of a diagonal brace, that is fixed to the plates and apply especially tensile forces thereto, the plates cannot withstand to the forces with a relatively high magnitude, without being ruptured. The option of increasing the thickness of the plates that those connectors are composed of, in most cases, gives away the other advantages of being hollow.

Most of the connectors other than hollow formed ones, generally don't have the disadvantage of poor loadability, but their problem is that, they attach the framework components, by means of certain modifications on the polyhedron shape, adding physical features, surface area or converting the polyhedron into another type of a polyhedron with additional faces to receive the framework components, when needed. So far, those solutions, failed to make their connectors to receive the framework components without getting oversized, especially for the cases with the same connectors in the system without that framework components. For example, in the prior art document, with the publication number US 2008/0175655 A, a cube shaped connector is suggested with a pair of extensions in the form of arms on a peripheral edge of each face of the connector, to form loops, wherein a diagonal connection with a hook-shaped end, is received and retained therein. But however, in order to locate the arms, the flat formed face elements are separated from each other and located at a distance at least the same as the length of the arms, increasing the overall size. The length of the arms must further be increased, for the cases the diagonal connection approaches to the surface of the bar, due to the angle therebetween, to prevent the end of the diagonal connection interfere with the surface of the bars. Furthermore, when a panel element with peripheral edges shaped in relation to the bars, is located in between a pair of bars, being surrounded thereby, the arms extend toward the panel element interfering therewith and brings a problem of making undesirable arrangements at the corners of that panels. That type of panel attachment is used frequently, especially in temporary framework systems like exhibition systems.

Therefore, the object of my invention is to produce a connection node, with a connector, connecting framework components and bars, especially bars with cross sections shaped circular or as a regular convex polygon, in a supporting framework system, substantially without being oversized, for both of the cases, the case with the framework components and the case, when those connectors are also used without the framework components.

3. DISCLOSURE OF THE INVENTION

For the purpose I stated above and in accordance with the invention, I suggest a supporting framework, having nodes and at least one framework component. The framework components are either panels or diagonal braces or a combination of them. At least one node has a connector and at least one bar. At least one connector has a plurality of bar receiving members that are located in a corresponding plurality of faces of an imaginary polyhedron and at least one bar has a first end, fixed to the one of the bar receiving members of the connector of a first node and a second end, fixed to the corresponding bar receiving member of the connector of another node.

The supporting framework is characterized in that; the bar receiving members are in plate form and at least one connector further has an inner core, located in between the bar receiving members and the inner core has projections, each projecting toward one of the bar receiving members and connected to the back faces of them, the corresponding connector, further has at least one receiving plate, having a receiving member and each of the receiving plates is located between an adjacent couple of the projections of the inner core, and connected thereto, substantially, on an imaginary plane that passes through the longitudinal axes of each of the projections of the adjacent couple thereof, projecting toward the back faces of a corresponding adjacent couple of the bar receiving members and being connected thereto, whereby the receiving plates, the inner core and the bar receiving members, together, define a cavity, inside the imaginary polyhedron, at substantially at least one side of the receiving plate and the corresponding node further comprises at least one component holder having at least one supporting face and at least one projection and the component holder is located substantially in between the proximal portions of a first bar and a second bar, the second bar is adjacent to the first bar and the proximal portions of the bars are facing each other and the supporting face is located contacting with and substantially enclosing the proximal portion of at least of the one of the corresponding adjacent couple of the bars and the projection of the component holder projects inward the cavity, reaches the receiving member of at least one receiving plate and is releasably connected thereto and at least one framework component is connected to the component holder of the connector of at least two of the nodes, whereby a supporting framework is produced, wherein, the load of the framework components that is transferred to the node, is not taken and the stabilization of the framework components is not enabled, by the connector directly, but, shared between the connector and the surface of the bars. That collaboration decreases the share of the connector and the receiving plates, on load bearing and stabilizing the framework components 102, in accordance with the component holder and its projection, and a component holder, substantially as described and in accordance with the invention, is used with a preferable connector, having disc shaped bar receiving members that are located substantially at a tangential position to others, in a corresponding plurality of faces of an imaginary cube, the connector receiving cylindrical bars, with diameters substantially the same as the imaginary cube edges. Thus, a connector is produced, which is not over-sized, yet having the ability of being connected to framework components in a supporting framework system.

For the purposes stated above and in accordance with the invention, I suggest another supporting framework, having nodes and at least one framework component. The framework components are either panels or diagonal braces or a combination of them. At least one node has a connector and at least one bar. At least one connector has a plurality of bar receiving members that are located in a corresponding plurality of faces of an imaginary polyhedron and at least one bar has a first end, fixed to one of the bar receiving members of the connector of a first node and a second end, fixed to the corresponding bar receiving member of the connector of another node.

The supporting framework is characterized in that; the bar receiving members are in plate form and at least one connector further has an inner core, located in between the bar receiving members and the inner core has projections, each projecting toward one of the bar receiving members and connected reversibly to the back faces of them, the corresponding connector, further has at least one receiving plate, having a receiving member and each of the receiving plates, is located between an adjacent couple of the projections of the inner core, and connected thereto, substantially, on an imaginary plane that passes through the longitudinal axes of each of the projections of the adjacent couple thereof, projecting toward the back faces of a corresponding adjacent couple of the bar receiving members and being connected thereto, whereby the receiving plates, the inner core and the bar receiving members, together, define a cavity, enlarging towards inside of the imaginary polyhedron, at substantially at least one side of the receiving plate, the corresponding node further comprises at least one holder, having a first portion located in the cavity, substantially in between at least three adjacent receiving plates and the holder is shaped such that, the first portion can be placed in the cavity with a removal of at least one of the corresponding bar receiving members and is retained therein when the bar receiving members are replaced, the first portion extends towards the receiving member of at least one receiving plate and is releasably connected thereto and a second portion of the holder extends outward the connector and at least one framework component is connected to the holder of the connector of at least two of the nodes. The movability of the bar receiving members enable the holder to use the cavity, inside the imaginary polyhedron, more effectively and to be able to be connected to a plurality of receiving plates when necessary. Thus, a framework node is produced wherein; the connector's capacity of attaching framework components, especially diagonal braces, is improved with regard to the capacity of a polyhedron shaped connector, of the same overall size and with faces immovable. In accordance with the invention, this improvement enables, a preferable connector, to be produced, having disc shaped bar receiving members that are located substantially at a tangential position to others, in a corresponding plurality of faces of an imaginary cube, receiving cylindrical bars, with diameters substantially the same as the imaginary cube edges, the connector, yet, having the ability of being connected to framework components.

Preferably at least one holder, further comprises at least one supporting face and the second portion of the holder, extends outward the cavity towards a location substantially in between a proximal portion of a couple of the adjacent bars, and the supporting face thereof, is located contacting with and enclosing the proximal portion of at least one of the corresponding couple of the adjacent bars, whereby the load of the framework components is transferred both, to the receiving plates and to the surface of the bars but not directly to the bar receiving members.

4. BRIEF DESCRIPTION OF DRAWINGS

Figure 2A:
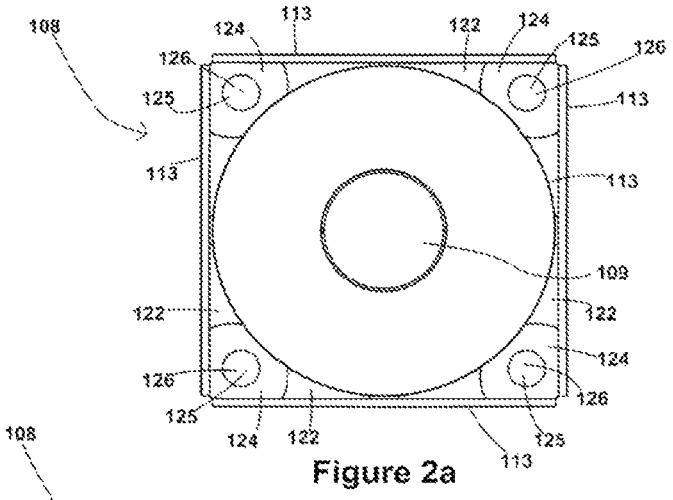
Figure 2B:
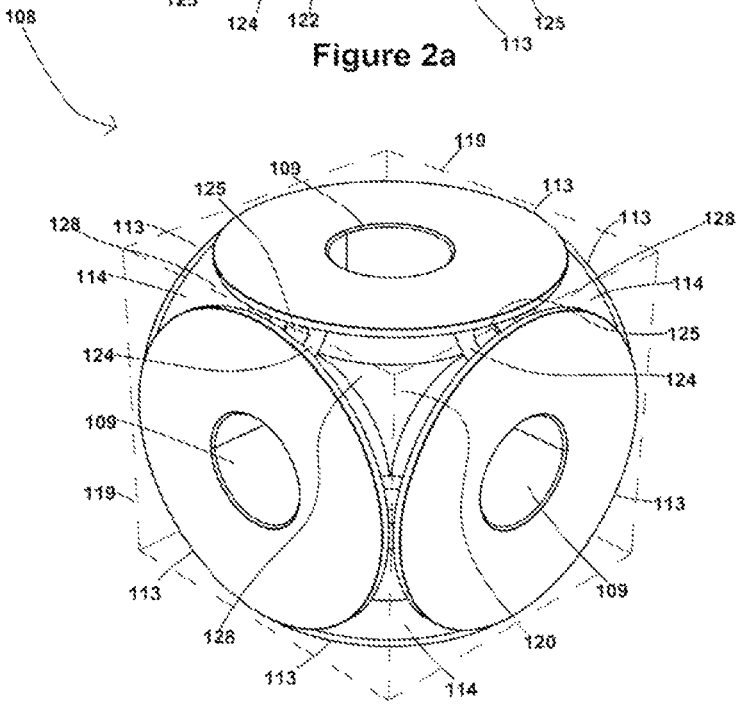
Figure 3A:
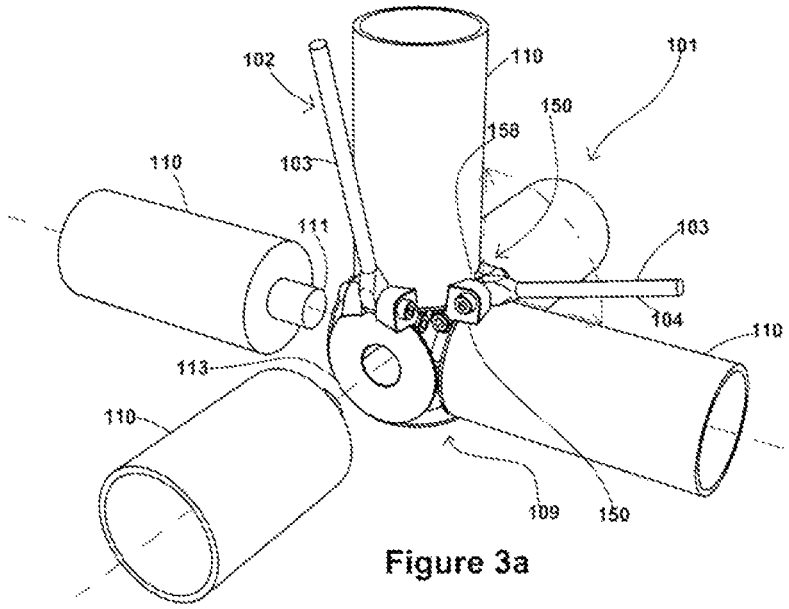
Figure 3B:
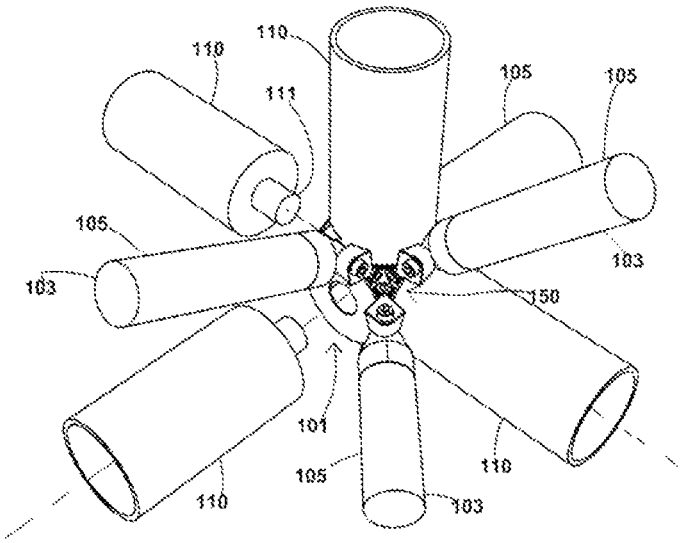
Figure 4A:
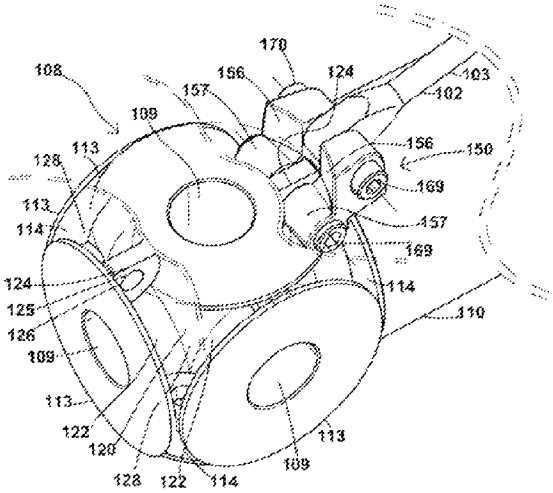
Figure 4B:
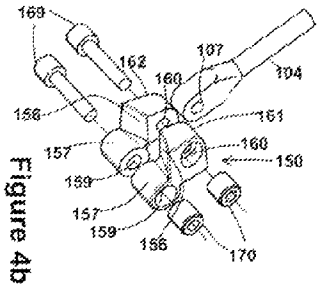
Figure 4C:
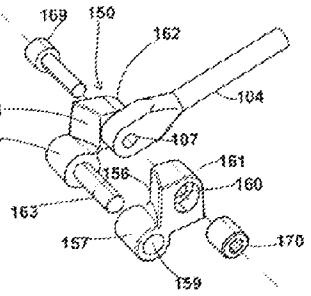
Figure 4D:
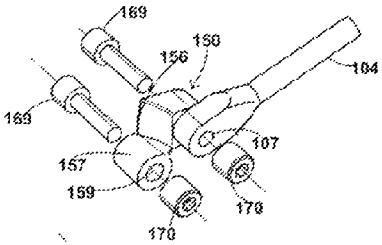
Figure 4E:
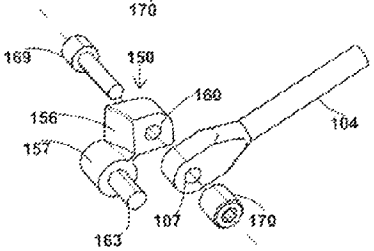
Figure 4F:
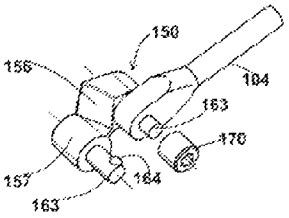
Figure 5:
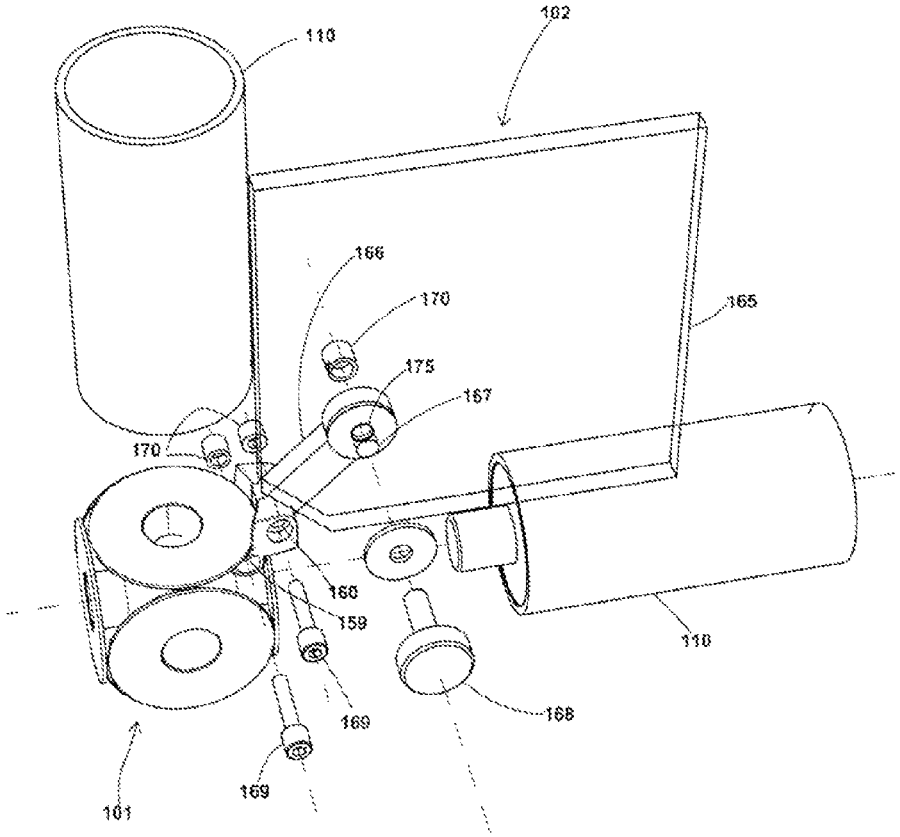
Figure 6A:
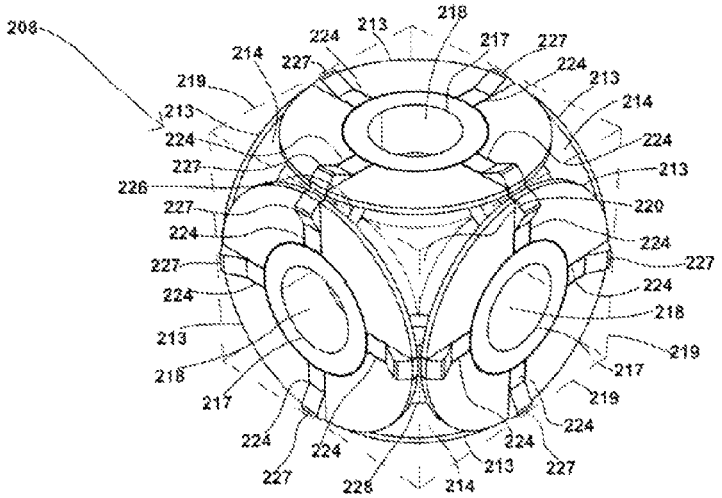
Figure 6B:
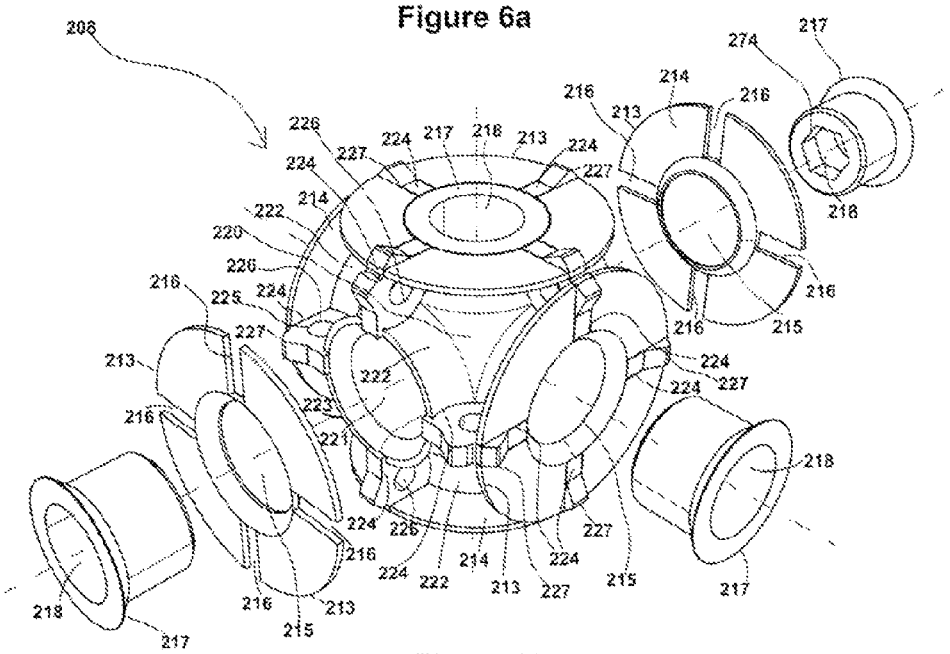
Figure 7:
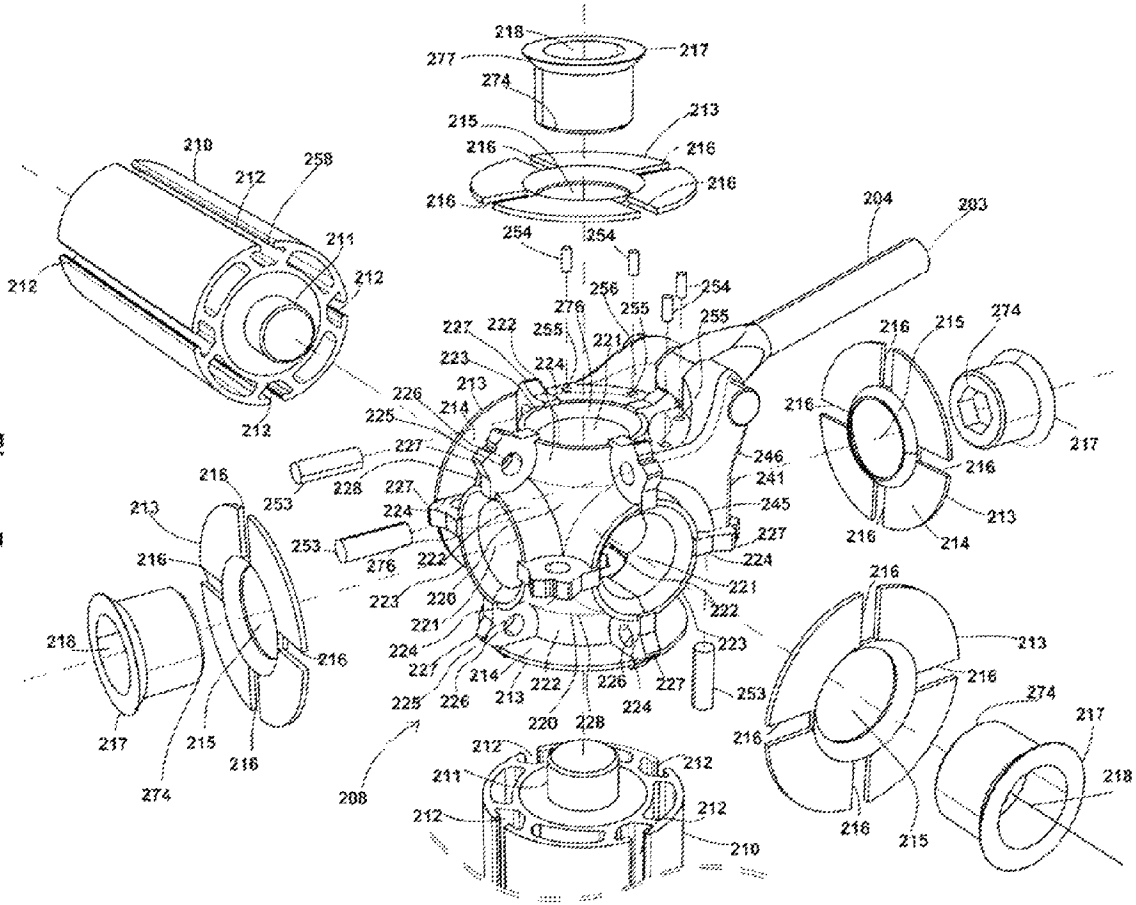
Figure 8:
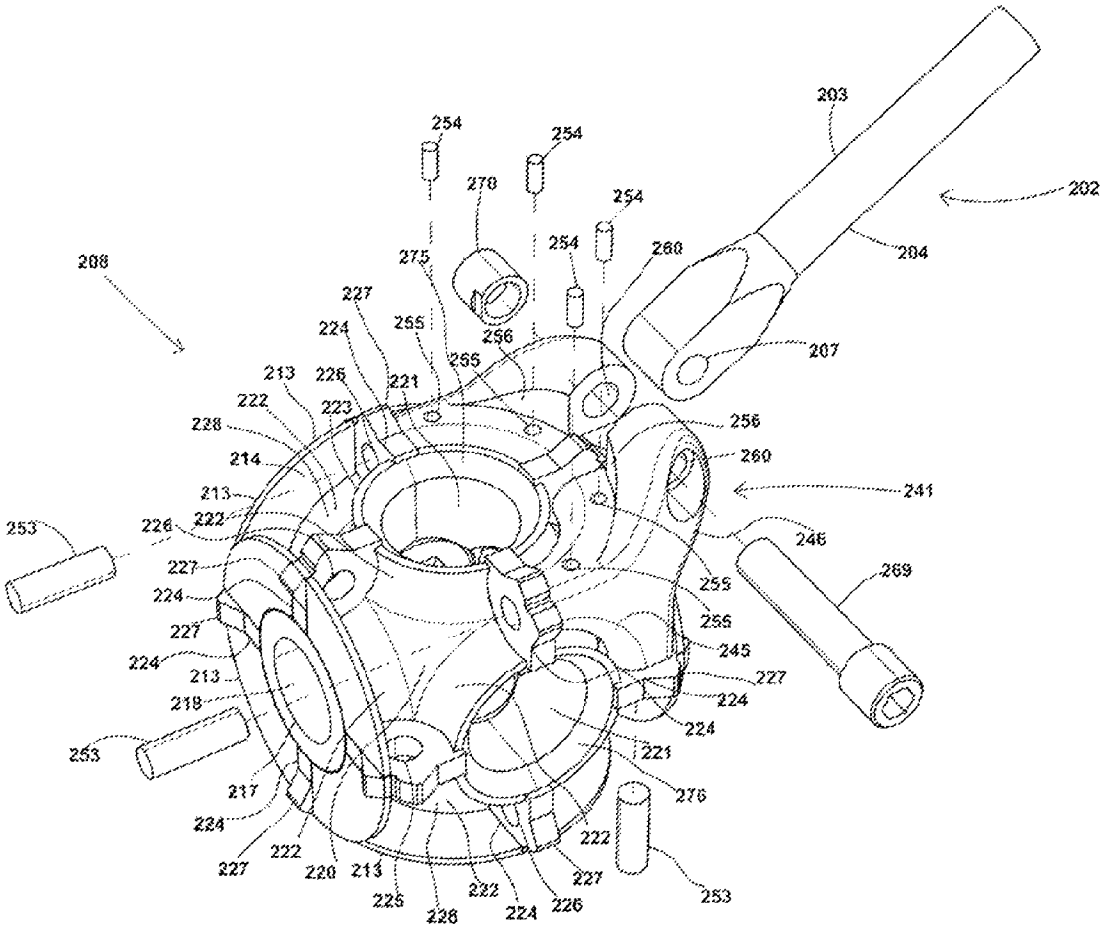
Figure 9A:
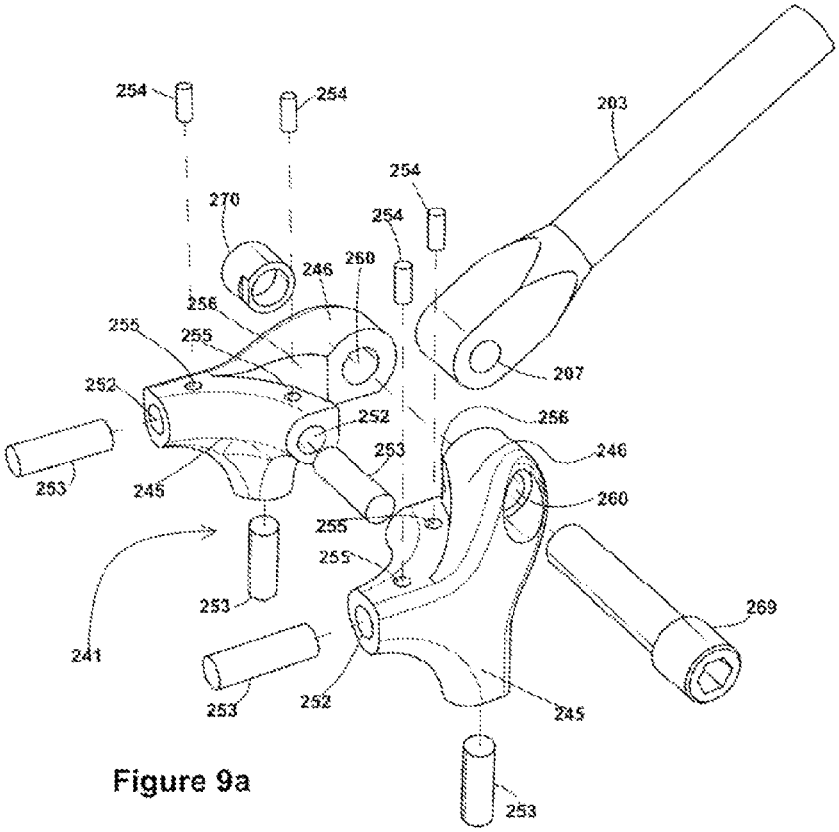
Figure 9B:
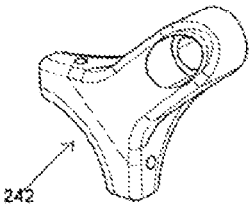
Figure 9C:
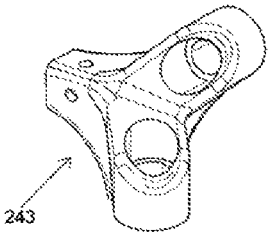
Figure 9D:
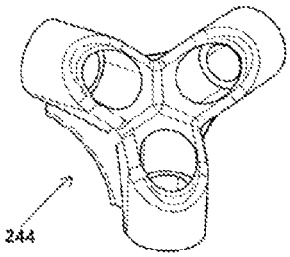
Figure 10:
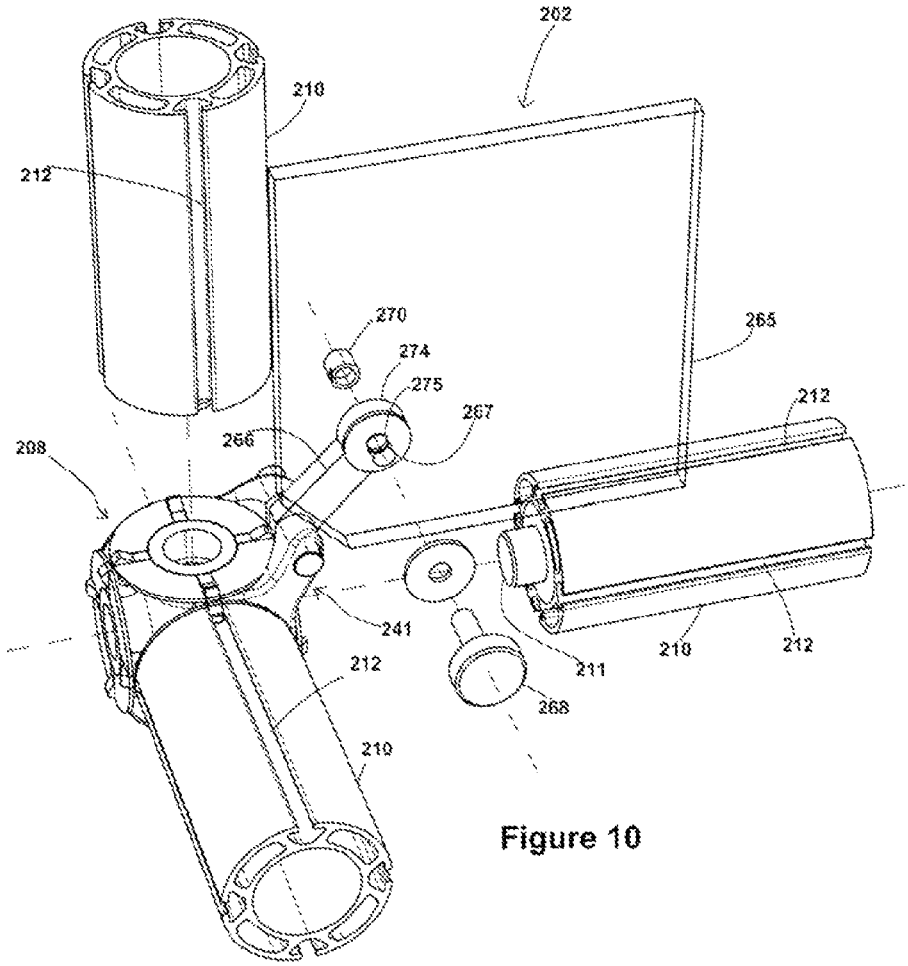

FIG. 1 is a perspective view of the framework node, showing the connection of the component holder, FIG. 2*a* is a side elevation of the connector, and FIG. 2*b* is a perspective view of the connector, FIGS. 3*a* and 3*b* are perspective views of the framework node with the component holder, FIG. 3*a* illustrates the diagonal tension brace as framework components and FIG. 3*b*, illustrates diagonal compression brace as framework components, FIG. 4*a* is a perspective view of the connector and illustrates the connection of the component holder to the connector, FIGS. 4*b*, 4*c*, 4*d*, 4*e* and 4*f* illustrate different examples of the component holder, FIG. 5 is a perspective view of the framework node, illustrating the panel connection to the node with a panel arm, FIG. 6*a* is a perspective view of the modular connector, FIG. 6*b* is an exploded perspective view of the modular connector, FIG. 7 is a perspective view of the framework node with the modular connector and illustrates the connection of the holder, FIG. 8 is a perspective view of the modular connecter and illustrates the connection of the holder, FIG. 9*a* is a perspective view of the holder and FIGS. 9*b*, 9*c* and 9*d*, illustrate different examples of the holder, FIG. 10 is a perspective view of the framework node, with the modular connector and the panel arm, illustrating the panel connection to the node with a panel arm

5. BEST MODES FOR CARRYING OUT THE INVENTION

With reference to the embodiment shown in FIG. 1, bars 110 are connected to the connector 108, to produce a framework node 101. The node 101 receives a framework component 102. The framework component 102 can be a diagonal brace 103 or a panel 165 as shown in FIG. 5 that I will mention later. The diagonal brace 103 can be either a diagonal tension brace 104 or a diagonal compression brace 105. The connector 108 has bar receiving members 113. The bar receiving members 113 are shaped in relation to the cross section shape of the bars 110. As shown in FIG. 1, the bar receiving members 113, are located in a corresponding plurality of faces of the imaginary polyhedron 119. The imaginary polyhedron 119 is basically a cube, but it can be shaped as another type of a polyhedron. The bar receiving members 113, are in plate form and preferably circular shaped, but it is also possible to shape the plates as convex polygons, like hexagon or octagon (not shown). The connector 108 has an inner core 120. The inner core 120, is located in between the bar receiving members 113. The inner core 120, has projections 122, and each of these projections 122, extend toward one of the bar receiving members 113 and connected to the back faces 114 of them. In cases when the imaginary polyhedron 119 is a cube, the inner core 120 has six projections 122, each extending preferably perpendicular toward one of the six bar receiving members 113 and connected to the back faces 114 of them. The connector 108 also has receiving plates 124. Those receiving plates 124 are located between the adjacent couples of the projections 122 and connected to them. The receiving plates 124 are located on an imaginary plane that passes through the longitudinal axes of the adjacent couple of the projections 122, as shown in FIG. 2*b* and they extend toward the back faces 114 of the corresponding adjacent couple of the bar receiving members 113 and are connected to them. In the connector 108 with an imaginary polyhedron 119, which is a cube, there are twelve receiving plates 124 as shown in FIG. 2*b*. Each of the receiving plates 124 is partly hidden visually behind the bar receiving members 113, especially in the cases that the shape of the bar receiving members 113 are circular in relation with the cross section of the bars 110 and doesn't increase the overall size of the imaginary polyhedron 119. In addition to its role on receiving the framework components 102, the receiving plates 124 also stabilizes the connector 108 and improves the load bearing capacity of the connector 108 significantly and without impairing the aesthetical appearance of the connector 108. Each receiving plate 124 has a receiving member 125. Inside the imaginary polyhedron 119, the receiving plates 124, the inner core 120 and the bar receiving members 113, together define a cavity 128 at preferably each side of each of the receiving plates 124.

The node 101 further has at least one component holder 149 as shown in FIG. 1. The component holder 149 is located substantially in between the proximal portions 158 of a first and a second bar 110 as shown in FIG. 1. Here the bars 110 are adjacent to each other and their proximal portions 158 are facing each other. The component holder 149 has at least one supporting face 156 and at least one projection 157. The supporting face 156, when properly located, contacts thoroughly and encloses the proximal portion 158 of the bars 110 and the projection 157 projects inward the cavity 128, reaches the receiving member 125 of at least one receiving plates 124 and is releasably connected thereto. At least one framework component 102 is connected to the component holder 149 of the connector 108 of at least two of the nodes 101. Thus, a supporting framework is produced, wherein, the load of the framework components 102 that is transferred to the node 101, is not taken and the stabilization of the framework components 102 is not enabled, by the connector 108 directly, but, shared between the connector 108 and the surface of the bars 110. That collaboration decreases the share of the connector 108 and the receiving plates 124, on load bearing and stabilizing the framework components 102 and in accordance with the projection 157, and in accordance with the invention, a component holder 149, substantially as described, can be used with a preferable connector 108, having disc shaped bar receiving members 113 that are located substantially at a tangential position to others, in a corresponding plurality of faces of an imaginary cube, the connector receiving cylindrical bars 110, with diameters substantially the same as the length of the edges of the imaginary cube. Thus, a connector 108 is produced, which is not over-sized, yet having the ability of being connected to framework components 102 in a supporting framework system.

FIG. 3*a* shows diagonal tension braces 104 connected to the connector 108 as framework components 102 and FIG. 3*b* shows diagonal compression braces 105 connected to the connector 108. Diagonal compression braces 105 are the framework components 102 among others that most benefit from the concept of collaboration of the bars 110 with the connector 108 on bearing the load of the framework components 102. Because, when loaded, the diagonal compression braces 105 is pressed toward the proximal portion 158 of the bars 110, in a manner being urged to preserve their relative position to the bars 110 and transfer their load mainly on the bars 110 and significantly decreases the role of the receiving plates 124 and the projection 157 of the component holder 149. The same is true to some extend, for the diagonal tension braces 104. The share of the bars 110, in the collaboration with the connector 108, on bearing the load of the diagonal tension braces 104, is inversely proportional to the magnitude of the angle between the bars 110 and the diagonal tension braces 104. At relatively small angles like 10-15 degrees as frequently used in trusses, the component holder 149 can transfer a considerable amount of the load of the diagonal tension brace 104 to the surface of the bar 110 and press the diagonal tension braces 104 toward the proximal portion 158 of the bars 110, in a manner urging to preserve their relative position to the bars 110, decreasing the share of the connector 108 on bearing the load of the diagonal tension braces 104 and on stabilizing them. As a result, the projections 157 of the component holders 149 of the can be sized small enough to be used with circular shaped bar receiving members 113 that are located at a tangential position to others. The connectors 108 receiving cylindrical bars 110 are among the connectors that are most likely to be oversized to receive the framework components 102. Because the cylindrical bars 110 cover the faces of the imaginary polyhedron of the connectors thoroughly, leaving no room for placing features to receive the framework components 102. The connectors in known systems failed to solve that problem without over-sizing the connector. I solve that problem by means of the inventive framework node 101, one of the embodiment examples of which is illustrated in FIG. 1.

The component holder 149 can be produced in various different versions. The component holder 149 that is shown in FIG. 1 is a one piece version. FIGS. 3*a, b* and 4*a, b, c* show the component holder A 150, having a first body 161, located at the one side of the receiving plate 124, and a second body 162, located at the other side of that receiving plate 124. FIGS. 4*d, e* and *f* shows the component holder A 150, located at only one side of the receiving plate 124. Dividing the component holder 149 results in easier connection and enables the location of at least one component holder for each adjacent couple of the bars 110. The receiving member 125 of the receiving plate 124 is basically an eye 126, but it can be produced in the form of another type of a fastener, in relation with the corresponding projection 157 of the component holder A 150. In FIGS. 4*a* and 4*b*, the projection 157 of the component holder A 150, comprise an eye 159, aligned to the eye 126 of the corresponding receiving plate 124 and the component holder A 150, is connected to the receiving plate 124 by means of the bolt 169 that is inserted through each of the respective eyes 126 and 159 and the nuts 170. The diagonal brace 103 has a brace eye 107 at one end and the component holder A 150 has an eye 160. The diagonal brace 103 is located in between the first body 161 and the second body 162 of the component holder A 150, the brace eye 107 is aligned to the eye 160 of the component holder A 150 and the diagonal brace 103 is connected pivotally to the first body 161 and the second body 162 by means of the bolt 169 and the nut 170. Other types of fastener can also be used like a pin and an external retaining ring (not shown). In FIG. 4*c* one of the component holders A 150, has a mating protrusion 163, that, when connected to the diagonal brace 103, protrudes toward the eye 159, received and retained by the eye 159. That can result in faster connection. In the FIG. 4*f*, the component holder A 150 has another mating protrusion 163 aligned and received by the brace eye 107 and the mating protrusion 163 has a spring ball 164 as shown in FIG. 4*f*, that provides additional resistance for the mating protrusion 163, against an undesired dislocation of the component holder A 150 especially in the cases that the component holder A 150, located at only one side of the receiving plate 124, as shown in FIG. 4*f*. That spring ball 164 is a known element, having a spring, and a ball, that is placed in a bore, the spring pushing the ball (not shown). The FIG. 4*e* and *d* show different combinations of the connection of the component holder A 150.

The FIG. 5 illustrates a panel 165 as a framework component 102, connected to the component holder A 150. The panel preferably has a panel eye 167 and can be connected directly to the component holder A 150 by means of a bolt 169. However, the preferred connection is made by means of a panel arm 166 that is connected to the component holder A 150 as shown in the FIG. 5. The panel arm 166 has an eye 175 at the distal end and the panel 165 has a panel eye 167. The panel 165 is placed in a position that the panel eye 167 is aligned to the eye 175 of the panel arm 166 and the panel 165 is connected to the panel arm 166 by means of a panel tap 168, that is inserted through the panel eye 167 and the eye 175 of the panel arm 166 and a nut 170. The FIG. 5 also shows that the connector 108 comprise a mating bore 109, on each of the bar receiving members 113, extending radially inward each of the corresponding projection 122 of the inner core 120 and the bars 110 comprise a bar end 111 preferably at each end of them. The bar end 111 is a protrusion, sized in relation to the mating bore 109 and the bar ends 111 of each bar 110 are inserted into the mating bore 109 of the corresponding connector 108.

The FIG. 6*a, b* and FIG. 7 illustrate, in accordance with the invention, another framework node 201. The connector 208 connects bars 210 to produce the framework node 201. As shown in FIG. 7 the node 201 receives framework component 202. The framework component 202 in the FIG. 7 is a diagonal tension brace 204. The framework component 202 can be a diagonal brace or a panel 265 as shown in FIG. 10 that I will mention later. The diagonal brace 203 can is either a diagonal tension brace 204 or a diagonal compression brace 205. The connector 208 has bar receiving members 213. The bar receiving members 213 are shaped in relation to the cross section shape of the bars 210. As shown in FIG. 6*a*, the bar receiving members 213, are located in a corresponding plurality of faces of the imaginary polyhedron 219. The imaginary polyhedron 219 is basically a cube, but it can be shaped as another type of a polyhedron. The bar receiving members 213, are in plate form and preferably circular shaped, but it is also possible to shape the plates as convex polygons, like hexagon or octagon (not shown). The connector 208 has an inner core 220. The inner core 220, is located in between the bar receiving members 213. The inner core 220, has projections 222, and each of these projections 222, extend toward one of the bar receiving members 213 and connected reversibly to the back faces 214 of them. In cases when the imaginary polyhedron 219 is a cube, the inner core 220 has six projections 222, each extending preferably perpendicular toward one of the six bar receiving members 213 and connected reversibly to the back faces 214 of them. The connector 208 also has receiving plates 224. Those receiving plates 224 are located between the adjacent couples of the projections 222 and connected to them. The receiving plates 224 are located on an imaginary plane that passes through the longitudinal axes of the adjacent couple, as shown in FIG. 7 and they extend toward the back faces 214 of the corresponding adjacent couple of the bar receiving members 213 and being connected to them. In the connector 208 with an imaginary polyhedron 219, which is a cube, there are twelve receiving plates 224 as shown in FIG. 6*b*. Each of the receiving plates 224 is partly hidden behind the bar receiving members 213, especially in the cases that the shape of the bar receiving members 213 are circular due to the cross section of the bars 210 and doesn't increase the overall size of the imaginary polyhedron 219. In addition to its role on receiving the framework components 202, it also stabilizes the connector 208 and increases the load bearing capacity of the connector 208 significantly and without impairing the aesthetical appearance of the connector 208. Each receiving plate 224 has a receiving member 225. The receiving plates 224, the inner core 220 and the bar receiving members 213, together define a cavity 228, enlarging towards inside, at preferably each side of each of the receiving plates 224.

The node 201 further has at least one holder 241 as shown in FIG. 7. The holder 241 is located in the cavity 228, substantially in between at least three adjacent receiving plates 224. The holder 241 is shaped such that, the first portion 245 can be placed in the cavity 228 with a removal of at least one corresponding bar receiving member 213 and is enclosed and retained therein when the bar receiving members 213 are replaced. The first portion 245 extends towards the receiving member 225 of at least one receiving plate 224 and is releasably connected thereto and the second portion 246 of the holder 241 extends outward the connector 208 as shown in FIG. 7 and FIG. 8. At least one framework component 202 is connected to the holder 241 of the connector 208 of at least two of the nodes 201. The movability of the bar receiving members 213 enable the holder 241 to use the cavity 228, inside the imaginary polyhedron 219, substantially and to be connected to a plurality of receiving plates 224 when necessary, whereby a connector 208 is produced with a capacity of attaching framework components 202, especially diagonal braces 203, that is improved with regard to that of a polyhedron shaped connector, of the same overall size and with faces immovable. In accordance with the invention, this improvement enables, a preferable connector 208, to be produced, having disc shaped bar receiving members 213 that are located substantially at a tangential position to others, in a corresponding plurality of faces of an imaginary cube, receiving cylindrical bars 210, with diameters substantially the same as the length of the edges of the imaginary cube, the connector 208, yet, having the ability of being connected to framework components 202.

Preferably, the holder 241, further comprises at least one supporting face 256 as shown in the FIG. 8 and the second portion 246 of the holder 241, extends outward the cavity 228 towards a location substantially in between a proximal portion 258 of a couple of the adjacent bars 210, and the supporting face 256, comes into a substantially contacts with and enclose the proximal portion 258 of at least one of the couples of the adjacent bars 210, whereby the load of the framework components 202 is transferred both, to the receiving plates 224 and to the surface of the bars 210 but not directly to the bar receiving members 213.

The bar receiving members 213 are connected to the inner core 220 by means of the plate connector 217. The plate connector 217 has a mating bore 218 at the first end, extending radially toward a second end 274 and the projections 222 of the inner core 220, comprise a mounting bore 221 at the distal end 223, extending radially inward. The bar receiving members 213 comprise an opening 215. The bar receiving members 213 are mounted on the distal end 223 of the respective projection 222 of the inner core 220 by means of the plate connector 217, inserted through the openings 215 of the bar receiving members 213 into the corresponding mounting bores 221 of the projections 222 of the inner core 220. The second end 274 of the plate connector 217, can be shaped, such that a simple fastener can be inserted into the mating bore 218, and easily fasten the plate connector 217. The bars 210 comprise a bar end 211 preferably at each end of them. The bar end 211 is a protrusion, sized in relation to the mating bore 218 and the bar ends 211 of each bar 210 are inserted into the mating bore 218 of the corresponding connector 208.

Each of the bar receiving members 213, have preferably have passages 216. In a preferred connector 208, with the imaginary polyhedron 219 that is a cube, there are basically four passages 216. Each of the passages 216 are superposed to one of the receiving plates 224 and each of the receiving plates 224 has a protrusion 227, that protrudes toward the corresponding passage 216 and the protrusion 227 is received and retained therein, whereby any rotative motion of the bar receiving members 213, with regard to the longitudinal axis of the corresponding bars 210, is restrained. That restraining provides additional protection against an undesired dislocation of the bar receiving members 213.

In another preferred embodiment the bars 210 comprise slots 212 on their periphery, extending along the longitudinal axis of the bars 210. There are basically four slots 212 for each bar 210. Each one of the slots 212 is superposed to one of the protrusions 227 of the receiving plates 224, and the protrusion 227 of those receiving plates 224, protrude through the corresponding passages 216 of the bar receiving member 213 toward the corresponding slots 212 of the bars 210, the protrusions 227 are received and retained in the slots 212, whereby the rotative motion of the bars 210 with regard to their longitudinal axis, is restrained. That restraining provides additional protection against an undesired dislocation of the bars 210 and gives further resistance against the torsional movement of the bars 210, providing a positive effect on the load bearing capacity of the framework node 201. By means of the receiving plates 224 and especially that, they have protrusions 227, protruding through the passages 216 of the bar receiving members 213, the supporting role of the bar receiving members 213 is minimized and that can enable us to produce the bar receiving members 213 relatively thin and even from different materials like aluminum or plastic.

Preferably, the framework components 202 like diagonal braces 203 are located in between a two adjacent holders 241 and connected to the second portions 246 of them as shown in FIG. 8. However, any of those framework components 202 can be connected to one of the holders 241 and the second portions 246 of them can be shaped to orient to the position of the framework components 202. The holder 241 can be adapted to be used with a plurality of framework components 202. FIG. 9*b* shows one way holder 242, adapted to be used with only one framework component 202, FIG. 9*c* shows two way holder 243, adapted to be used with two framework components 202 and FIG. 9*d* shows three way holder 244, adapted to be used with three framework components 202. As shown in the figures different types of diagonal braces 203 can be used in combination, without interfering the others.

As I mentioned before, a framework component 202 can either be a diagonal brace 203 or a panel 265. Each of the diagonal braces 203 preferably has a brace eye 207 at one end and the second portion 246 of the holder 241 preferably has an eye 260. The brace eye 207 is aligned to the eye 260 of the holder 241 and the diagonal brace 203 is connected pivotally to the second portion 246 of the holder 241 by means of a bolt 269 and a nut 270. Other types of fasteners can also be used like a pin and an external retaining ring (not shown). The panel 265 can be connected directly to the holder 241, but preferably the panels 265 are connected to the holder 241 by means of a panel arm 266, that is connected to the holder 241 as shown in the FIG. 10. The panel 265 preferably has a panel eye 267 and the panel arm 266 has an eye 275 at the distal end. The panel 265 is placed in a position that the panel eye 267 is aligned to the eye 275 of the panel arm 266 and the panel 265 is connected to the panel arm 266 by means of a panel tap 268, that is inserted through the panel eye 267 and the eye 275 of the panel arm 266 and a nut 270.

As shown in FIG. 9*a* the ends of the first portion 245 of the holder 241 comprise mounting bores 252. The mounting bores 252 are aligned to the receiving member 225 of the receiving plates 224. In this case the receiving member 225 of the receiving plate 224 is an eye 226. However, it can be shaped as another fastener in relation to the first portion 245 of the holder 241. The holder 241 is connected to the receiving plate 224 by means of a pin 1 253, that is located in the mounting bore 252 and inserted into the eye 226 of the corresponding receiving plate 224. In the case of the imaginary polyhedron 219 is a cube, the first portion 245 of the holder 241 is connected basically to three adjacent receiving plates 224, thus, comprise three mounting bores 252. However, that number can vary, depending on the shape of the first portion 245 and that number of the receiving plates 224 that the first portion is adapted to reach. As shown in FIG. 9*a*, the holder 241 comprises pinholes 255 on the first portion 245 to use with the pins 2 254. The pins 2 254 are used to adjust the position of the pins 1 253 inside the mounting bore 252 of the first portion 245 to enable locking and unlocking the connection.

6. INDUSTRIAL APPLICABILITY

All of the connectors and the connection elements can be produced with high quality stainless steel casting. Panel arms can be produced easily and economically with a conventional punch and bending process. The diagonal braces can be produced with conventional machining process. The bars can be made of aluminum and aluminum extrusion process can be used to produce the bars with custom cross sections, like bars with slots.

I claim:

1. A supporting framework, comprising:

a plurality of nodes;

at least one framework component, wherein the framework component is selected from a group, comprising at least one diagonal brace, at least one panel and combinations thereof, wherein at least one of the nodes comprises at least one connector and at least one bar;

wherein the connector comprises a plurality of bar receiving members, which are located in a corresponding plurality of faces of an imaginary polyhedron;

the at least one bar comprises a first end, which is fixed to one of the bar receiving members of the connector of a first node; and a second end, which is fixed to a corresponding bar receiving member of the connector of another node, wherein the bar receiving members are in plate form;

at least one of the corresponding connectors further comprises an inner core and at least one receiving plate, wherein the inner core is located in between the bar receiving members, wherein the inner core further comprises a plurality of projections, wherein each of the projections projects toward one of the bar receiving members and connected to the back faces thereof, wherein each of the receiving plates comprises a receiving member which is an eye and is located between an adjacent couple of the projections of the inner core, and is connected thereto on an imaginary plane that passes through the longitudinal axes of each of the projections of the adjacent couple thereof, extends toward the back faces of a corresponding adjacent couple of the bar receiving members and is connected thereto, whereby the receiving plates, the inner core and the bar receiving members together define a cavity, inside the imaginary polyhedron, on at least one side of the receiving plate;

at least one of the corresponding nodes further comprises at least one component holder, wherein the component holder comprises at least one supporting face and at least one projection, and is located in between a proximal portion of a first bar and a proximal portion of a second bar, wherein the second bar, adjacent to the first bar and the proximal portion of the first bar, faces the proximal portion of the second bar, wherein the at least one supporting face contacts with the proximal portion of at least one of the adjacent couple of the bars in a manner enclosing the proximal portion thereof, and wherein the projection of the component holder projects inward the cavity, reaches the receiving member of at least one receiving plate and is releasable connected thereto; wherein the at least one projection of the at least one component holder, which comprises an eye, aligns to the eye of the corresponding receiving plates and wherein the component holder is connected to the corresponding receiving plate by means of a bolt that is inserted through each of the respective eye; and the at least one framework component is connected to the component holder of the connector of at least two of the nodes.

2. The supporting framework in accordance with claim 1, wherein the bar receiving members are disc shaped and located at a tangential position to the adjacent bar receiving members.

3. The supporting framework in accordance with claim 1, wherein the at least one component holder is shaped in a manner enabling the location of the at least one component holder for each adjacent couple of the bars.

4. The supporting framework in accordance with claim 1, wherein the at least one component holder comprises a first body and a second body, wherein the first body is located at one side of the corresponding receiving plate, wherein the second body is located at another side of the receiving plate.

5. The supporting framework in accordance with claim 1, wherein the projection of the at least one component holder projects inward the cavity at only one side of the corresponding receiving plate.

6. The supporting framework in accordance with claim 5, wherein the projection of the component holder comprises a mating protrusion, wherein the mating protrusion aligns to the receiving eye of the receiving plate, protrudes toward the receiving eye, and is received and retained there within.

7. The supporting framework in accordance with claim 1, wherein the at least one framework component is a diagonal brace, and is connected pivotally to the component holder.

8. The supporting framework in accordance with claim 7, wherein the at least one framework component is a panel and the corresponding node comprises at least one panel arm, wherein a first end of the panel arm is connected to the component holder and a second end of the panel arm is connected to at least one panel.

9. The supporting framework in accordance with claim 1, wherein the at least one bar is cylindrical.

10. The supporting framework in accordance with claim 1, wherein the at least one connector on each of the bar receiving members comprises a mating bore, and extends radially inward each of the corresponding projection of the inner core, and wherein an end of the at least one bar is inserted into one of the mating bores.

11. The supporting framework in accordance with claim 1, wherein the imaginary polyhedrons of at least one connector is a cube.

* * * * *